US008623251B2

(12) United States Patent
White et al.

(10) Patent No.: US 8,623,251 B2
(45) Date of Patent: Jan. 7, 2014

(54) EXTRUDED AND CONFIGURED LATHE-CUT PACKER ELEMENTS

(75) Inventors: James R. White, Goshen, IN (US); Geoffrey A. Naylor, Ligonier, IN (US); Michael T. Hooley, Elkhart, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 889 days.

(21) Appl. No.: 11/776,702

(22) Filed: Jul. 12, 2007

(65) Prior Publication Data

US 2008/0011488 A1 Jan. 17, 2008

Related U.S. Application Data

(60) Provisional application No. 60/807,077, filed on Jul. 12, 2006.

(51) Int. Cl.

| | |
|---|---|
| ***B28B 11/12*** | (2006.01) |
| ***B28B 11/08*** | (2006.01) |
| ***B28B 11/14*** | (2006.01) |
| *E21B 33/12* | (2006.01) |

(52) U.S. Cl.
USPC ..... 264/151; 264/162; 166/179; 166/387

(58) Field of Classification Search
USPC ..... 264/150, 157, 159, 209.6, 151
See application file for complete search history.

(56) References Cited

U.S. PATENT DOCUMENTS

| | | | | |
|---|---|---|---|---|
| 2,180,795 | A * | 11/1939 | Christensen | 277/448 |
| 2,930,082 | A * | 3/1960 | Foss et al. | 138/145 |
| 3,335,624 | A * | 8/1967 | Cline | 82/117 |
| 3,545,321 | A * | 12/1970 | Read et al. | 82/47 |
| 3,722,245 | A | 3/1973 | Yamamoto et al. | |
| 3,866,501 | A * | 2/1975 | Glendenning et al. | 83/382 |
| 3,904,341 | A | 9/1975 | Putti | |
| 3,916,598 | A | 11/1975 | Adams et al. | |
| 3,942,805 | A | 3/1976 | Sundqvist | |
| 4,147,824 | A | 4/1979 | Dettmann et al. | |
| 4,256,314 | A | 3/1981 | Berglund et al. | |
| 4,290,994 | A | 9/1981 | Murakami et al. | |
| 4,318,319 | A * | 3/1982 | Scholin | 82/47 |
| 4,720,113 | A | 1/1988 | Hertz, Jr. | |
| H556 | H | 12/1988 | Tarko | |
| 4,941,309 | A | 7/1990 | Fluent et al. | |
| 5,145,190 | A | 9/1992 | Boardman | |
| 5,207,047 | A | 5/1993 | Prignitz | |
| 5,230,149 | A | 7/1993 | Martin | |
| 5,297,804 | A | 3/1994 | Siegrist et al. | |
| 5,459,202 | A | 10/1995 | Martinez et al. | |
| 6,243,990 | B1 | 6/2001 | Cornils et al. | |
| 6,268,031 | B1 | 7/2001 | Bleibler | |
| 6,270,082 | B1 | 8/2001 | Hegemier | |
| 6,365,250 | B2 | 4/2002 | Shifman et al. | |
| 6,508,972 | B1 * | 1/2003 | Lietz | 264/407 |

(Continued)

*Primary Examiner* — Jeffrey Wollschlager
(74) *Attorney, Agent, or Firm* — Renner, Otto, Boisselle & Sklar, LLP.

(57) ABSTRACT

A process for making packer elements for use in sealing an area between surfaces in a wellbore and packer elements formed from that process. The process includes extruding an elastomeric material to form a tubular structure and machining the outer surface of the tubular structure to provide a desired surface geometry. The tubular structure may be machined to provide a contoured surface geometry. The tubular structure with a contoured surface geometry may be machined to form a plurality of packer elements, which are separated by cutting the tubular structure.

19 Claims, 5 Drawing Sheets

(56) References Cited

U.S. PATENT DOCUMENTS

| | | | |
|---|---|---|---|
| 6,588,762 | B2 | 7/2003 | Boone et al. |
| 6,659,020 | B1 | 12/2003 | Ball |
| 6,686,012 | B1 | 2/2004 | Molnar et al. |
| 2001/0043963 | A1 | 11/2001 | Zhang et al. |
| 2004/0035168 | A1 | 2/2004 | Kanamaru et al. |
| 2004/0036225 | A1 | 2/2004 | Ritter et al. |
| 2004/0142135 | A1 | 7/2004 | Verschuere et al. |
| 2006/0090839 | A1 | 5/2006 | O'Dowd |
| 2006/0277744 | A1 | 12/2006 | Wink et al. |
| 2006/0280887 | A1 | 12/2006 | Duke et al. |

* cited by examiner

EXTRUDED AND CONFIGURED LATHE-CUT PACKER ELEMENTS

CROSS REFERENCE TO RELATED APPLICATIONS

This application claims priority to U.S. Provisional Application No. 60/807,077 filed on Jul. 12, 2006, the entire disclosure of which is incorporated herein by reference.

TECHNICAL FIELD

The present invention relates to packer elements, particularly packer elements for use in sealing an area between surfaces in a wellbore, and to methods for making packer elements.

BACKGROUND

In subterranean installations such as oil well installations in the oil and gas industry, geothermal wells, and the like, a pipe is typically located within a bore hole or casing and radially spaced from the wall of the bore hole or the inner wall of the casing. Downhole packers, also referred to as packer elements, are typically used for sealing the annular space between the pipe and the casing or bore wall. Packers may serve various functions including protecting the wellbore casing from corrosive fluids, protecting the casing from various pressures including well and stimulation pressures, holding kill fluids or treating fluids within the casing annulus, and/or isolating formations or leaks within the casing or multiple producing zones so as to prevent fluid from migrating between zones.

Packer elements heretofore have been formed from a thermoset rubber material. The packer element is installed by running the element into a wellbore where it is anchored typically by use of a mechanical compression setting tool or fluid pressure device. When the packer element is in place, compression in an axial direction will cause the packer element to expand radially and contact the inner surface of the casing or wellbore in a tightly sealed relationship.

Typically, the radial outer surface of the packer element is contoured to allow the packer element to adjust within the annular space and move into place as it is pressurized. The packer elements having a contoured radial outer surface heretofore have been formed by molding processes.

SUMMARY

The present invention provides a process for manufacturing packer elements for use in applications such as sealing the space between a pipe and casing or borehole in subterranean installations used within various industries. The process enables the avoidance of one or more drawbacks associated with the prior art practice of molding packer elements, including the avoidance of the cost of having to provide a separate mold for packer elements with different surface geometries, and the avoidance of structural weaknesses caused by voids, knit lines, or flow lines that result from previously used molding processes. Consequently, the present invention enables the provision of a packer element not plagued by defects commonly associated with prior art molding processes.

According to one aspect of the invention, a process for manufacturing a packer element includes extruding an elastomeric material to form a tubular structure, and machining the radial outer surface of the tubular structure to provide a desired surface geometry.

The surface geometry may be a contoured geometry. In particular, the contoured geometry may have one or more regions selected from an angled region, a curved region, a chamfered region, a shoulder, a groove, a depression, or combinations of two or more thereof.

The process may be used to form from a single extruded tubular structure, a plurality of packer elements having a contoured radial outer surface, where the packer elements are separated by cutting the tubular structure.

The radial outer surface may be machined using a grinding tool, a forming tool, a cutting tool, or a combination of two or more thereof. In particular, a grinding wheel may be used as the grinding tool.

The machining process may be carried out on any suitable machining tool such as a lathe, a chucking lathe, a milling machine, or a specialized machine tool. A particularly suitable machining tool is a lathe.

The process may include machining the radial outer surface of the tubular structure to provide a substantially uniform outer surface. The tubular structure may be circular, and the process may include machining the radial outer surface of the tubular structure to provide a concentric cylinder.

The elastomeric material may be a rubber material and may be cured prior to machining.

The present invention also provides packer elements, in particular a packer element formed from a process according to the present invention. The packer element may be used for sealing an area between two surfaces, such as between concentric surfaces in a wellbore, by installing a packer element formed by the process according to the present invention between the surfaces.

Further features of the invention will become apparent from the following detailed description when considered in conjunction with the drawings.

DETAILED DESCRIPTION

Figure 1:
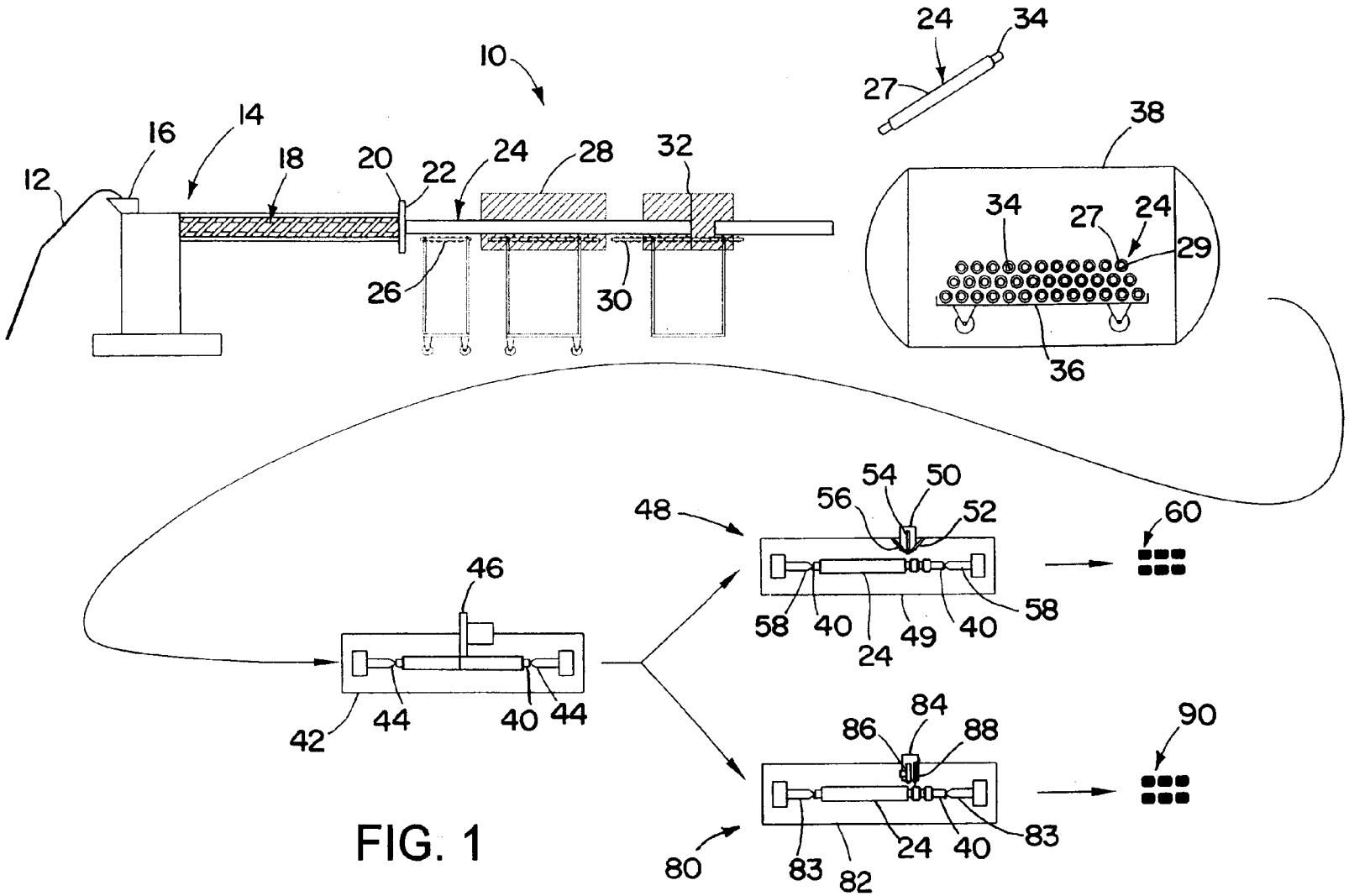
FIG. 1 illustrates an exemplary apparatus for carrying out a process for manufacturing packer elements from an extruded tubular structure in accordance with the invention.

A process in accordance with the present invention may be used to form packer elements suitable for use in sealing the area between surfaces in a wellbore such as between a well pipe and a casing or borehole wall as may be found in subterranean installations used within various industries, such as the oil and gas industries. Generally, the process comprises extruding an elastomeric material to form a tubular structure, and machining the radial outer surface of the tubular structure to provide a desired surface geometry. The tubular structure may be machined to form a plurality of packer elements having a radial outer surface with a contoured geometry, after which the packer elements are separated from one another.

As used herein, the term "tubular structure" refers to the tubular structure formed from the extrusion process and to any tubular workpiece formed from the extruded tubular structure prior to being formed as a finished packer element. An extruded tubular structure has a radial inner surface and a radial outer surface and wall thickness defined by the distance between the inner and outer surface. The tubular structure may have any shape as desired for a particular purpose or intended use including, but not limited to, circular, oval, elliptical, rectangular, square, triangular, and the like.

The term "surface geometry" refers to the overall shape of a surface of the tubular structure or finished packer element. The term "surface geometry" may be used to refer to the configuration of the radial outer surface (radial outer surface geometry) or the radial inner surface (radial inner surface geometry). In one embodiment the radial outer surface may be substantially uniform or regular (non-contoured) over the entire length of the tubular structure or packer element. In one embodiment, the radial outer surface may have a contoured geometry. A contoured surface geometry may be defined by one or more angled regions, curved regions, chamfered regions, depressions, grooves, shoulders, and the like, and combinations of two or more thereof, along the radial outer surface of the tubular structure and/or the finished packer element. The regions defining the contoured geometry may run in the axial or radial direction of the tubular structure and/or the packer element. A contoured surface may also include one or more cylindrical regions in combination with one or more angled regions, curved regions, chamfered regions, depressions, and/or grooves. A contoured surface may include two or more cylindrical regions vertically offset from one another. Depressions or grooves may be rounded, squared, angled or any other configuration as desired. The contoured surface may also be a threaded surface formed by a groove or grooves running in a helical pattern about the radial outer surface. The surface geometry of the radial outer surface, including a contoured surface geometry, may be selected as desired for a particular purpose or intended use.

The tubular structure may be machined using any suitable tool including, for example, a grinding tool, a forming tool, a cutting tool, or combinations thereof. Suitable forming tools include, but are not limited to, right cut tools, left cut tools, curved tools, rounded tools, square nosed tools, tapered tools, knurling tools, and the like. In one embodiment, the grinding tool may be a grinding wheel having a desired profile or geometry to impart the desired contour to the radial outer surface of the tubular structure. An example of a suitable cutting tool is a knife or blade. The cutting tool may be angled relative to the longitudinal axis of the tubular structure to provide the desired contour.

The machining process may be carried out on any suitable machining tool. Suitable machining tools include, but are not limited to, a lathe, a chucking lathe, a milling machine, and/or a custom machine tool. In a machining process employing a lathe, an extruded tubular structure may be placed on a mandrel, positioned in a lathe, rotated at a selected speed, and the radial outer surface of the tubular structure may be contoured by indexing a grinding tool, a forming tool, a cutting tool, or combinations thereof, into the tubular structure to abrade material from the tubular structure. Generally, the grinding tool(s), forming tool(s) and/or cutting tool(s) are attached to a carriage assembly that may be moved axially and lineally in relation to the rotating mandrel and tube.

A plurality of packer elements may be formed from an extruded tubular structure by machining the tubular structure to provide a plurality of packer elements having a radial outer surface with a desired surface geometry, such as a contoured geometry, and cutting through the thickness of the tubular structure to separate the packer elements. The tubular structure may be cut at an angle perpendicular to the longitudinal axis to provide a packer element having a straight axial end face, or the tube may be cut at an angle relative to the longitudinal axis of the tubular structure to provide a packer element having an angled end face.

The tubular structure may be formed by extruding an elastomeric material. Any elastomeric material may be used as desired for a particular purpose or intended use. In one embodiment the elastomeric material may be a rubber material. Suitable rubber materials may include natural or synthetic, thermosetting of vulcanizable rubbers including, but not limited to, nitrile rubber, polyisoprene rubber, buna-N rubber,ethylene-propylene rubber (EPR), ethylene-propylene-diene-monomer (EPDM), nitrile-butadiene rubber (NBR), styrene-butadiene rubber (SBR), blends of rubbers, and the like. In one embodiment the elastomeric material is a thermoset material. In a process using a thermoset material, the extruded tubular structure may be cured to provide the material with the desired physical properties.

Referring now to the drawings, FIG. 1 illustrates an exemplary apparatus for carrying out a process for forming one or more packer elements in accordance with the present invention. Apparatus 10 includes feeding a rubber material, such as rubber strips 12 to an extruder 14 through an inlet 16. The rubber material is conveyed through the extruder by a screw 18. The extruder 14 includes a head 20 that includes a pin and die set 22 and an aperture (not shown), which establishes the shape of the extruded structure. The screw 18 conveys the uncured rubber material to the pin and die set at a high pressure and the rubber is extruded through the aperture to form a continuous tube or extruded tubular structure 24 having a central, longitudinal axis 25, a radial outer surface 27, and a radial inner surface 29 (See FIGS. 2 and 4). The aperture is dimensioned to provide a tube having a shape (e.g., circular, oval, etc.), interior dimensions, and/or wall thickness as desired for a particular purpose or intended use. The extrusion process is not limited in any manner and may employ any type of screw configuration as desired.

Additionally, the tubular structure may be formed as a single layer structure or as a multi-layer structure such as by a cross-head or co-extrusion process.

Optionally, the extruded tubular structure 24 may be cooled prior to curing the extruded tubular structure. As shown in FIG. 1, extruded tubular structure 24 may be conveyed, via conveying device 26, to a cooling tunnel 28.

The cooling tunnel lowers the temperature of the extruded tubular structure, which may increase the rigidity of the structure and/or impart thermal shrinkage to the material used to form the tube. The cooling may be accomplished by a spray process, a submersion process, or any other process suitable for cooling an extruded workpiece as is now known or later discovered by persons skilled in extrusion methods.

Typically, the extruded tubular structure is extruded as a long continuous tube, and it may be desirable to cut the tube into smaller sections to provide smaller length tubular structures that can be easily handled during further processing such as, for example, during the machining step. As shown in FIG. 1, the apparatus 10 further includes conveying the extruded tubular structure, via conveying device 30, to a cutter 32, where the extruded tubular structure is cut into a plurality of tubular structure of a desired length.

After being cut, the extruded tubular structure may then be cured. As shown in FIG. 1, an extruded tubular structure is placed on a curing mandrel 34 and placed in an environment, such as curing vessel 38, suitable to effect curing the rubber material used to form the tubular structure. Any suitable method including, but not limited to, applying heat and/or pressure to the tubular structure may be used to cure the tubular structure. As shown in FIG. 1, a plurality of tubular structures loaded onto an apparatus such as curing truck 36 and placed in curing vessel 38 to be cured.

The use of a curing mandrel, such as mandrel 38, is optional but may be desirable to establish a finished inside surface shape and/or dimension within a specified tolerance after curing. A curing mandrel may have any shape and size as desired for a particular purpose or intended use. The shape may be a regular geometric shape, an irregular shape, or may have depressions, grooves, projections, or the like. A curing mandrel may have a relatively smooth surface, or a curing mandrel may have a patterned surface to provide the inner radial surface with a desired surface geometry or pattern.

After curing, the tubular structure(s) may be removed from the curing mandrel and subjected to any secondary or post-curing operations as desired. Such secondary or post-curing operations may be used to establish the final physical properties of the rubber compound used to form the tubular structure. Such secondary or post-curing operations are readily known and ascertainable by those skilled in the art of extrusion.

After curing, the tubular structures may be processed to form a tube having an outside surface, inside surface, and/or wall thickness within a desired dimensional tolerance. A tubular structure may be machined to provide a tubular structure having a substantially smooth or uniform (non-contoured) outer surface defining a regular geometric shape when viewing the axial end of the tube. The tube may be machined to provide an outside diameter with a roughness specification, wall thickness, or other dimensional feature within a desired dimensional tolerance. As illustrated in FIG. 1, for example, the circular tubular structure 24 is machined using a grinding lathe 42 to provide a tubular structure having a dimensioned outer diameter and to form a substantially concentric cylinder. The cured tubes are placed on a grinding mandrel and placed between centers 44 to hold the mandrel. The mandrel/tube assembly and grinding wheel 46 are rotated at a specified speed, and grinding wheel 46 is brought into contact the outer surface of the tubular structure to remove rubber from the outside of the tube.

After machining the tubular structure to provide a dimensioned tubular structure, the tubular structure is then machined to form packer elements having a contoured radial outer surface. The tubular structure may be machined using a grinding tool, a forming tool, and/or a cutting tool. The tubular structure may be machined (on a lathe, for example) to form a plurality of packer elements having a contoured radial outer surface and then cut and separated into individual packer elements.

Figure 2:
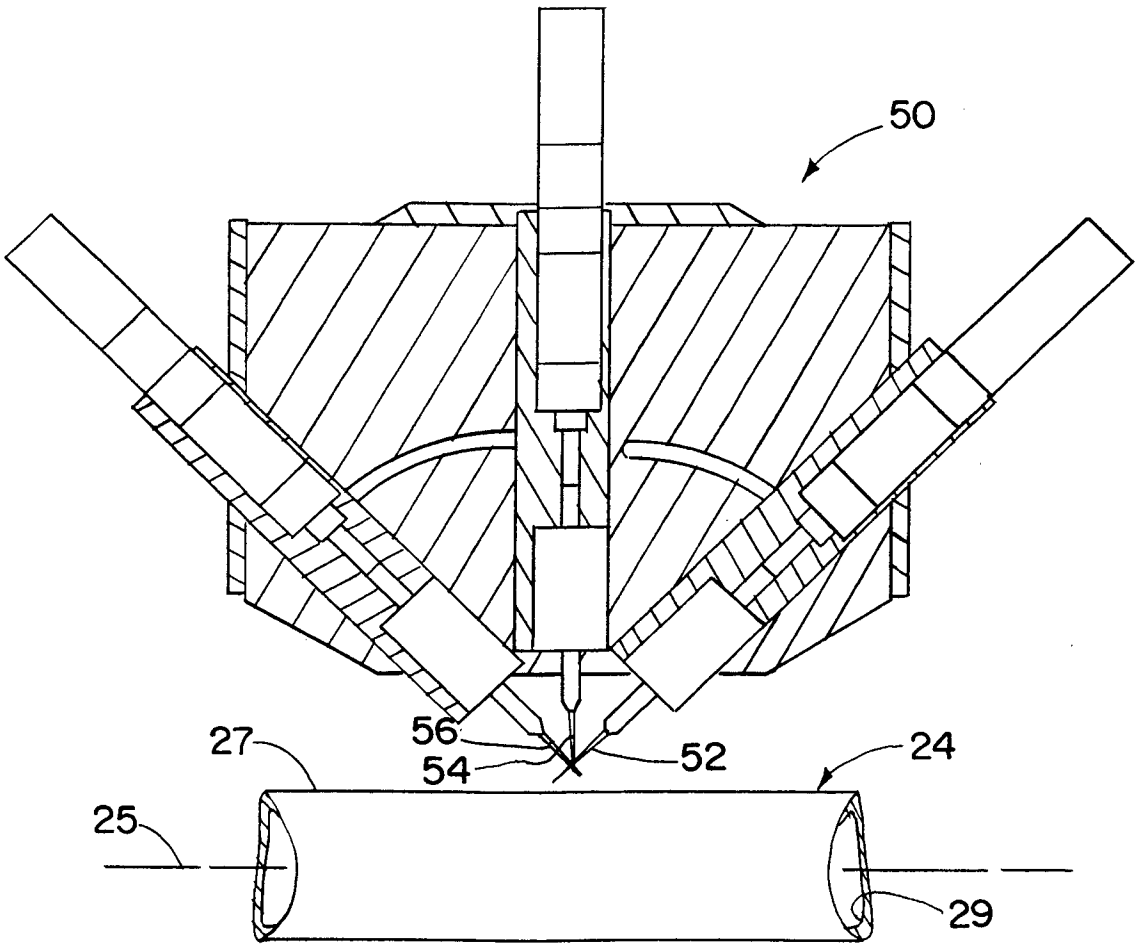
FIG. 2 illustrates a "knife-cut" machining apparatus for machining an outer radial surface of the tubular structure using one or more cutting tools to form a packer element.

In one embodiment, the radial outer surface of the tubular structure may be machined using a "knife-cut" process. As shown in FIG. 1, a knife-cut process 48 may employ a lathe 49 with a carriage assembly 50. Referring to FIGS. 1 and 2, the carriage assembly 50 includes knives 52, 54, and 56. Knife 54 is oriented perpendicular to the longitudinal axis of the tube 26 and knives 52 and 56 are oriented at angles relative to the longitudinal axis of the tubular structure. The carriage assembly 50 is shown as having three knives, but it will be appreciated that a multiple-knife assembly may include two or more knives as desired for a particular purpose or intended use. It will also be appreciated that the knives may be at a fixed angle (i.e., angled or perpendicular to the longitudinal axis of the tube or mandrel) or may be adjustable and moved as necessary for machining a packer element with a desired contoured geometry. The knives may be independently controlled in a manner that allows axial movement in relation to the rotating mandrel and tube. The carriage assembly may be controlled to allow lineal and axial movement of the knives in relation to the rotating mandrel and tube. While the mandrel/tube assembly is rotating, the knives may be independently indexed into the tube to create cuts of a desired angle.

To provide a plurality of packer elements 60, one of the knives cuts through the thickness of the tube 24 at a desired location to form an end (e.g., end 72 in FIGS. 3*a*-3*c*) of the packer element. Depending on the orientation of the knife cutting through the tubular structure, the ends of the packer element(s) may be substantially straight or perpendicular to the longitudinal axis of the packer element, or the ends may be angled or beveled.

Figure 3A:
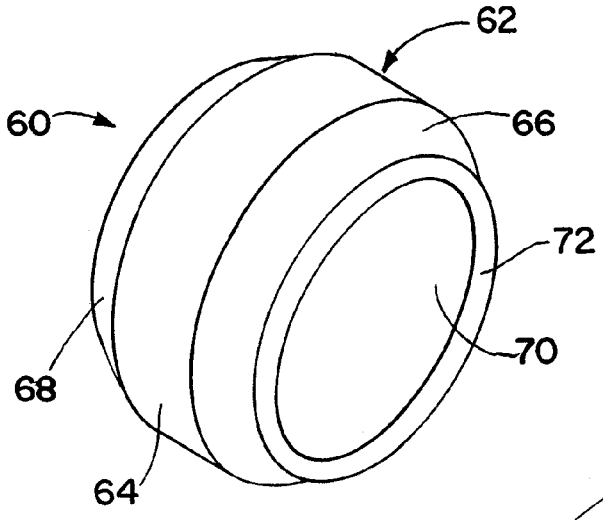
FIG. 3*a* is a perspective view of a packer element having a radial outer surface with a contoured geometry formed using a knife-cut process.
Figure 3B:
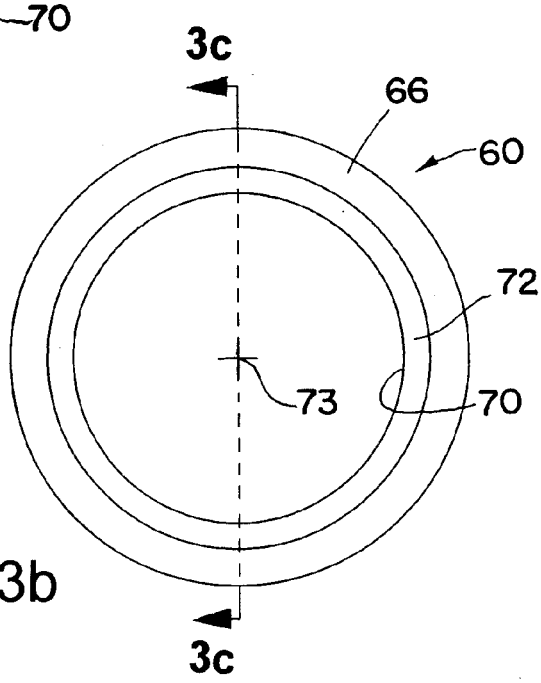
FIG. 3*b* is an axial end view of the packer element of FIG. 3*a;*
Figure 3C:
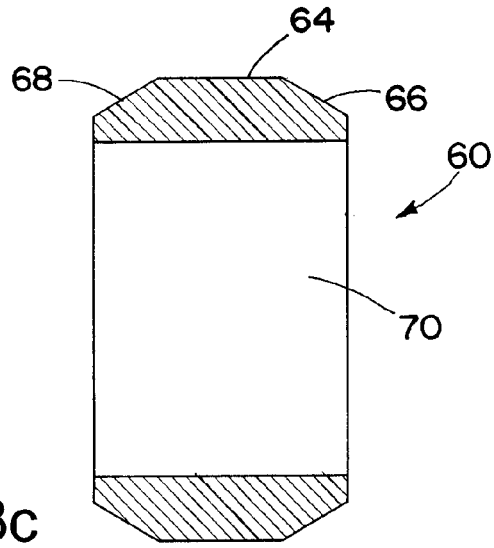
FIG. 3*c* is a cross-sectional view of the packer element of FIG. 3*b* taken along the line 3*c*-3*c;*

FIGS. 3*a*-3*c* illustrate a packer element 60 having a contoured surface geometry that is formed using a knife-cut machining process. Packer element 60 includes a radial outer surface 62, a radial inner surface 70, axial ends 72, and a central, longitudinal axis 73. Radial outer surface 62 is a contoured surface defined by a cylindrical region 64 (which is substantially parallel relative to the longitudinal axis of the packer element as illustrated in FIG. 3*c*) and angled regions 64 and 68. As shown in FIG. 3*c*, the angled regions 64 and 68 have the same angle. It will be appreciated that the angled regions on the radial outer surface of the packer element may have the same or different angles. It will also be appreciated that a contoured radial outer surface may be defined by any number of angled regions, including one, two, three, or more angled regions.

With reference to FIG. 1 again, a contoured radial outer surface may be provided by utilizing a grind-cut process 80. The tubular structure 26 is placed on a mandrel 40 and positioned between centers 83 of a lathe 82. The lathe includes a carriage assembly 84 having a grinding tool 86 and a knife 88. The grinding tool 86 and knife 88 are mounted to allow axial and lineal movement in relation to the rotating mandrel 40 and tube 26. The grinding tool 86 may include any profile to provide the radial outer surface of the tube with a desired contour or geometry. For example, a grinding tool may be employed to provide grooves, shoulders, curved regions, or the like. The profile on the grinding tool is transferred to the outer surface of the tube as the carriage is indexed toward the mandrel axis and rubber is abraded from the tube.

Figure 4:
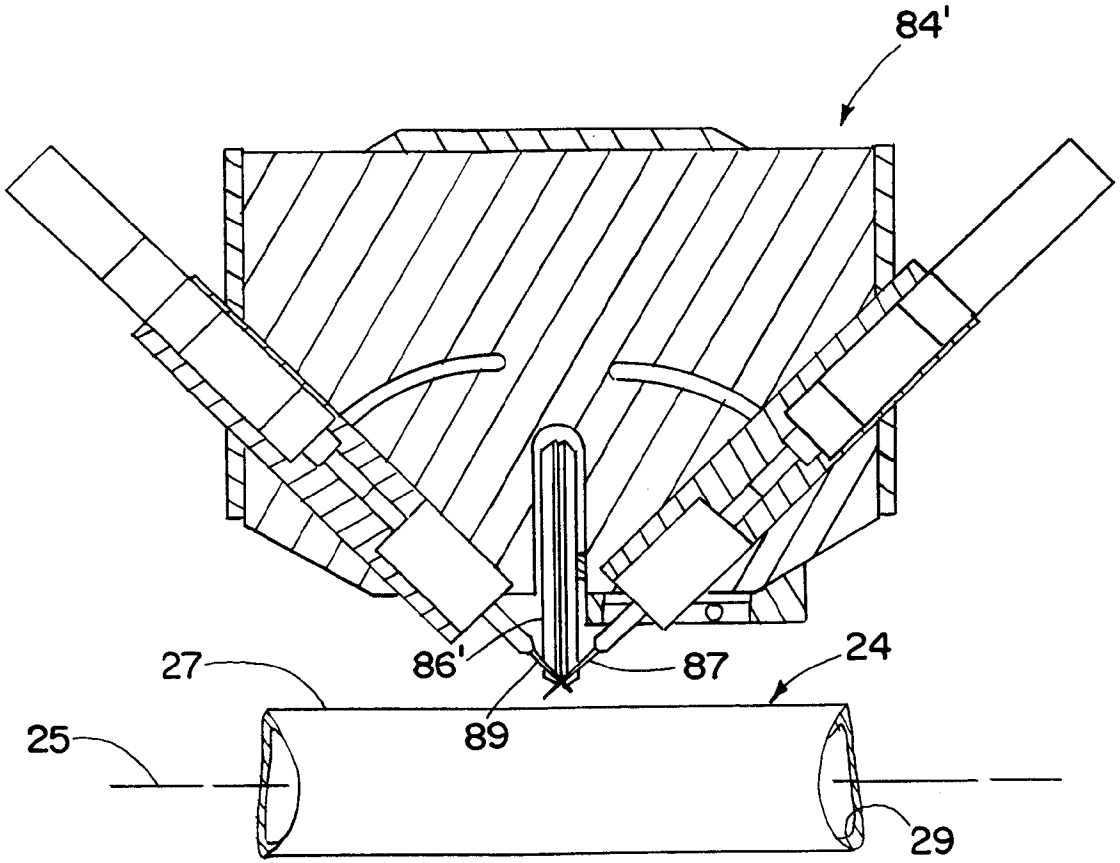
FIG. 4 illustrates a "grind-cut" machining apparatus for machining an outer radial surface of the tubular structure to form a packer element.

A carriage assembly in a grind-cut process may include one or more knives for use in machining the radial outer surface of the tubular structure to contour the radial outer surface. As shown in FIG. 1, the carriage 84 includes a single knife 88. Knife 88 is oriented perpendicular to the longitudinal axis of the mandrel 40 and tube 24. Knife 88 may be used to contour the radial outer surface of the tubular structure and/or cut through the tube perpendicular to the longitudinal axis of the tube to form a plurality of packer elements. It will be appreciated that the knife 88 may be oriented at an angle other than perpendicular to the longitudinal axis of the tube to provide a particular contoured geometry and or configuration for the axial ends of the packer elements. As shown in FIG. 4, for example, carriage 84' includes a grinding tool (in this case a grinding wheel 86') and knives 87 and 89. As shown in FIG.

4, knives 87 and 89 are angled relative to the longitudinal axis of the tube 26. The knives 87 and 89 may be independently controlled in a manner that allows axial and lineal movement in relation to the rotating mandrel and tube. The knives may be indexed independently into the rotating tube to form an angled region on the radial outer surface of the tube. Knives 87 and 89 may be used to machine the tubular structure in forming the contoured geometry and/or to cut through the thickness of the tubular structure to form a plurality of packer elements 90.

Figure 5A:
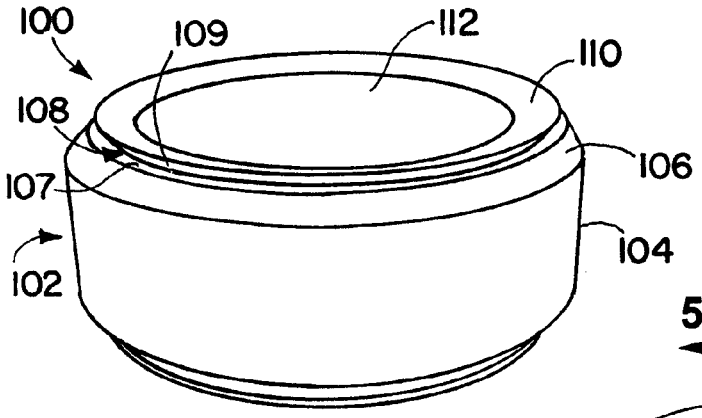
FIG. 5*a* is a perspective view of a packer element having a radial outer surface with a contoured geometry formed using a grind-cut machining apparatus.
Figure 5B:
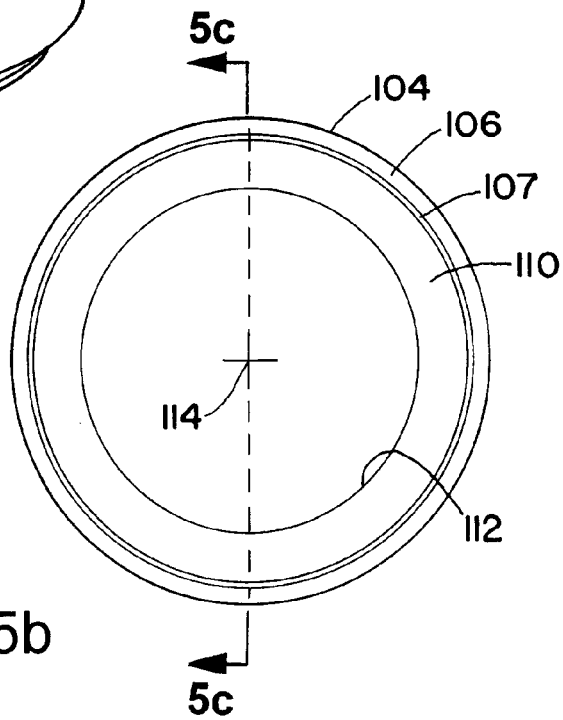
FIG. 5*b* is an axial end view of the packer element of FIG. 5*a;*.
Figure 5C:
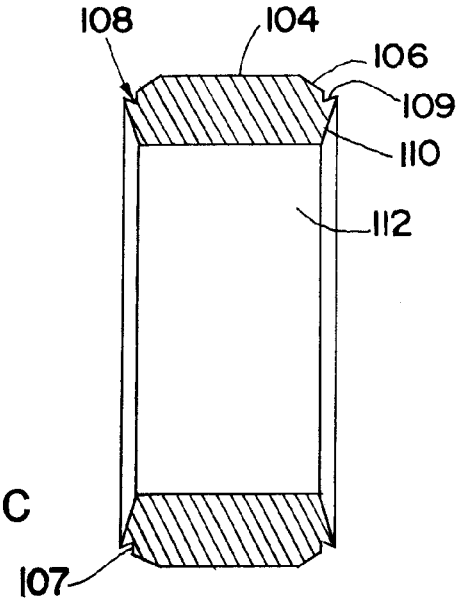
FIG. 5*c* is a cross-sectional view of the packer element of FIG. 5*b* taken along the line 5*c*-5*c*.

FIGS. 5*a*-5*c* illustrate a packer element 100 having a contoured radial outer surface formed from a grind cut process. Packer element 100 includes a radial outer surface 102 having a contoured geometry, a radial inner surface 112, and a central, longitudinal axis 114. The contoured geometry is defined by region 104 (which is shown as a cylindrical region), angled regions 106, and depressions or grooves 108, which are defined by walls 107 and walls 109. As shown in FIGS. 5*a*-5*c*, the packer element includes axial ends 110, which angle inward toward the inner radial surface 112.

After the tubular structure is machined and cut to form a plurality of packer elements having a contoured geometry, the packer elements may be removed from the mandrel and recovered. The packer elements may be removed from the mandrel by any suitable method such as, for example, by stripping the packer elements off the mandrel with the assistance of a pneumatic air gun.

A process in accordance with the present invention enables the avoidance of one or more drawbacks associated with the prior art practice of molding packer elements, including the avoidance of the cost of having to provide a separate mold for packer elements with different surface geometries, and the avoidance of structural weaknesses caused by voids, knit lines, or flow lines that result from previously used molding processes. Consequently, the present invention enables the provision of a packer element not plagued by defects commonly associated with prior art molding processes. For example, a process in accordance with the present invention may avoid expenses associated with molding operations, which require a different mold for each different packer configuration. A process in accordance with the present invention is flexible in that a separate apparatus is not required for forming parts with different configurations. Grinding tools and cutting tools may be easily interchanged and their angle of orientation relative to the longitudinal axis of the tubular structure may be readily adjusted as needed to provide the desired cuts and angles.

Packer elements formed in accordance with the present invention may have a radial outer surface with any contoured geometry as desired for a particular purpose or intended use. Additionally, packer elements may have any outer diameter as desired for a particular purpose or intended use. While a contoured radial outer surface will have an outer diameter that varies depending on the contoured geometry, the size of the packer element may be defined by the largest radial surface dimension. For example, in a packer element formed from a circular tube, the size of the packer element may be defined by the largest diameter. Packer elements may have an outer diameter of, for example, 3 inches, 7 inches, 13 inches, or even larger.

A process for manufacturing packer elements and packer elements formed by such a process have been described with reference to the foregoing description and various exemplary embodiments. The exemplary embodiments are merely illustrative and are not intended to limit the scope of the appended claims in any manner. It is appreciated that certain modifications may occur to persons skilled in the art upon reading the specification. It is intended that the invention include all such modifications as they come within the scope of the appended claims.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A process for manufacturing wellbore packer elements from an extruded tubular structure comprising an elastomeric material, the tubular structure having a radial inner surface and a radial outer surface; and the process comprising:

machining the radial outer surface of the tubular structure to provide a desired wellbore packer element surface geometry;

wherein the machining includes cutting the tubular structure with a cutting system having three knives that move along three different axes, the three knives being spaced apart along a longitudinal axis of the tubular structure and including a first knife configured to move perpendicular to a longitudinal axis of the tubular structure, and a second knife and a third knife configured to move at inclines relative to the first knife; and wherein the first knife is located along the longitudinal axis of the tubular structure between the second and third knifes and is operated independently of the second and third knifes to effect separation of a wellbore packer element from the tubular structure after angled surfaces are formed on the packer element by the second and third knives.

2. The process according to claim 1, wherein the machining step includes machining the radial outer surface to provide a contoured geometry.

3. The process according to claim 2, wherein the contoured geometry has one or more regions selected from, an angled region, a curved region, a chamfered region, a groove, a shoulder, or combinations of two or more thereof.

4. The process according to claim 1, wherein the radial outer surface is machined using at least one grinding tool, at least one forming tool, at least one cutting tool, or a combination of two or more thereof.

5. The process according to claim 4, wherein the at least one grinding tool is a grinding wheel.

6. The process according to claim 4, wherein the radial outer surface is machined using at least one cutting tool.

7. The process according to claim 4, wherein the radial outer surface is machined using at least one forming tool.

8. The process according to claim 1, wherein a plurality of wellbore packer elements are successively separated from the tubular structure by the first knife.

9. The process according to claim 1, wherein the machining step includes machining the radial outer surface of the tubular structure to provide a tubular structure with a substantially uniform, dimensioned radial outer surface.

10. The process according to claim 1, wherein the tubular structure is circular, and the machining step includes machining the radial outer surface to provide a cylindrical surface concentric with the longitudinal axis of the tubular structure.

11. The process according to claim 1, wherein the elastomeric material is selected from a rubber material.

12. The process according to claim 11, further comprising curing the extruded tubular structure prior to machining.

13. The process according to claim 1, wherein the second and third knives are inclined in opposite directions with respect to the first knife.

14. The process according to claim 1, comprising extruding the tubular structure.

15. The process according to claim 1, wherein the second and third knives are operated independently of one another to form angled surfaces on the wellbore packer element.

16. A process according to claim 15, wherein the second and third knives are used to form respective external chamfers at respective axially outer corners of the wellbore packer element.

17. A process for manufacturing wellbore packer elements from an extruded tubular structure comprising an elastomeric material, the tubular structure having a radial inner surface and a radial outer surface; and the process comprising:

machining the radial outer surface of the tubular structure to provide a desired wellbore packer element surface geometry having an outer diameter of at least 3 inches;

wherein the machining includes cutting the tubular structure with a cutting system having three knives that move along three different axes, the three knives including a first knife configured to move perpendicular to a longitudinal axis of the tubular structure to separate a wellbore packer element from the tubular structure, and a second knife and a third knife configured to move at inclines relative to the first knife; and wherein the second and third knives are operated independently of one another to form angled surfaces on the wellbore packer element.

18. A process according to claim 17, wherein the second and third knives are used to form respective external chamfers at respective axially outer corners of the packer element.

19. A process according to claim 17, wherein a plurality of wellbore packer elements are successively separated from the tubular structure by the first knife.

* * * * *